US005865690A

United States Patent [19]

Giannoutsos

[11] Patent Number: 5,865,690

[45] Date of Patent: Feb. 2, 1999

[54] AIRBORNE TEAM GAME APPARATUS AND PROJECTILE

[76] Inventor: Steve Giannoutsos, 3607 20th Rd., Long Island City, N.Y. 11105

[21] Appl. No.: 820,973

[22] Filed: Mar. 19, 1997

[51] Int. Cl.[6] ..... A63B 71/00

[52] U.S. Cl. ..... 473/415

[58] Field of Search ..... 473/415; 472/134

[56] References Cited

U.S. PATENT DOCUMENTS

| | | | |
|---|---|---|---|
| 4,457,509 | 7/1984 | St-Germain | 272/2 |
| 4,578,037 | 3/1986 | Macangus et al. | 434/258 |
| 5,772,535 | 6/1998 | Murphy | 473/415 |

FOREIGN PATENT DOCUMENTS 2062557 5/1981 United Kingdom .

*Primary Examiner*—William H. Grieb
*Attorney, Agent, or Firm*—Robert W. J. Usher

[57] ABSTRACT

Airborne team game apparatus including a rectangular chamber-form, playing court having an elastomeric mesh floor, transparent upstanding sidewalls, a mesh ceiling and goals on respective end walls. A series of fan outlets provide an airborne body supporting updraft throughout the court so that players can fly past each other during play while throwing a game projectile into a goal to score. The game projectile is molded in one piece from elastomeric material and has a spherical portion centrally mounted in an inwardly tapering, annular vane or wing.

20 Claims, 2 Drawing Sheets

AIRBORNE TEAM GAME APPARATUS AND PROJECTILE

FIELD OF THE INVENTION

The invention relates to apparatus for a competitive team game in which the players can maneuver around a court airborne or flying while attempting to score by throwing a projectile into a goal.

BACKGROUND OF THE INVENTION

Several apparatus are known for maintaining the body airborne in a strong updraft, both for simulating the free-fall experience of skydiving and for amusement of the user.

For example, UK patent application 2,062,557, published in 1981; discloses apparatus for simulating free-fall conditions; U.S. Pat. No. 4,457,507 issued to St-Germain in 1984 teaches a levitationarium for air flotation of humans; U.S. Pat. No. 4,578,037 issued to Macangus et al in 1986 teaches a skydiving simulator. However, none of the teachings of the references is suggestive of game apparatus of the present invention. The teachings of the above references are incorporated herein by reference in so far as they may be relevant.

SUMMARY OF THE INVENTION

According to one aspect, the invention provides apparatus for an airborne team game comprising means for providing a chamber-form playing court having a perforate floor, a peripheral wall upstanding therefrom and first and second opposite ends with first and second goals, respectively; a series of fans having outlets to the floor to provide an updraft throughout substantially the entire court, sufficient to support players bodies airborne, above the floor, so that individual players can traverse the court airborne between the goals during play while varying their elevations (positions in three dimensions) by varying the dispositions of their respective bodies in the updraft thereby to pass each other between the goals at different heights; and a game projectile which can be thrown by a player across the court into a selected goal to score.

Although a constant updraft pressure at a given height above the floor at all positions in the plating area of the court is preferred, any small areas of low pressure that may be formed in the court, for example, between adjacent fan outlets may also be exploited by the players to vary their elevations, providing different strategies of movement.

Preferably, at least a portion of the peripheral wall extending between the goals is transparent to enable spectators outside the court to view a game. More particularly, the court is rectangular in plan and has opposite major wall portions which are transparent and the floor comprises a player supporting elastomeric mesh while the court is enclosed at a top by ceiling formed by a player restraining mesh.

The game projectile has a spherical portion centrally mounted in an annular vane.

The invention includes the game per se,

BRIEF DESCRIPTION OF THE DRAWINGS

In order that the invention may be readily understood, a particular embodiment thereof will now be described by way of example only with reference to the accompanying drawings in which.

DESCRIPTION OF PARTICULAR EMBODIMENT

Figure 1:
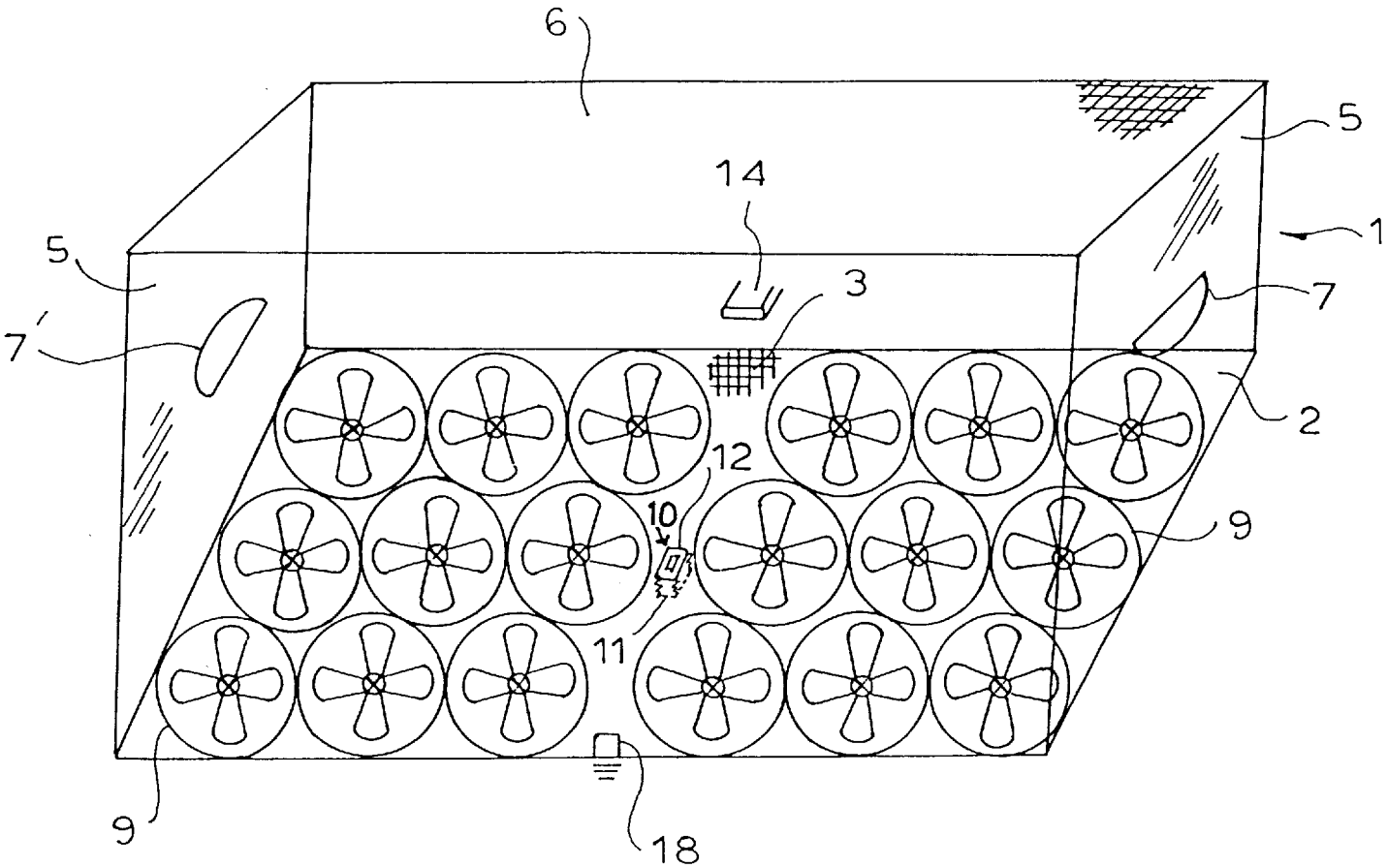
FIG. 1 is a schematic perspective view of the playing court of the apparatus according to the invention.

The game apparatus comprises a chamber-like playing court 1 formed by a rectangular, player supporting floor 2 of reinforced elastomeric mesh 3, upstanding opposed major side and end walls 4 and 5, respectively, of transparent, rigid, plastic such as PLEXI-GLASS, and a top wall or ceiling 6 of player restraining mesh 7 attached to top edges of the side and end walls. First and second, goals 7, 7' are formed by pockets in opposite end walls. A series of powerful fans 9 (eighteen in number, as shown) are mounted below the floor with outlets directed vertically upward through the floor to provide an updraft throughout substantially the entire court sufficient to support players bodies airborne above the floor so that individual players can traverse the court airborne at different heights between the goals during play while varying their elevations (positions in three dimensions) by varying the dispositions of their respective bodies in the updraft thereby to pass each other between the goals at different heights. The floor area is substantially equal to that of a basketball court and the wall height can be 15 to 20 feet. The airspeed of the updraft is approximately 100 mph or more.

A game projectile ejection means 10 comprising a bellows form, projectile delivering conduit 11 has an elastomeric mouth 12 located at a center of the court, with the mouth 12 flush with the floor 2 for yielding movement therewith. The conduit can be communicated with a fan draught by a flap valve (not shown). Alternatively, a spring may be provided therein to propel a projectile through the mouth into the court at the commencement of play.

Collapsible, player supporting platform perches 14 (only one shown) are mounted on portions of the side walls at locations spaced above the floor. The platforms are mounted to the wall by two pivotally connected arms forming a simple, conventional, over-center linkage, for hinging movement by a player between a collapsed position, lying against a sidewall and a horizontally extending, player supporting position.

Figure 2:
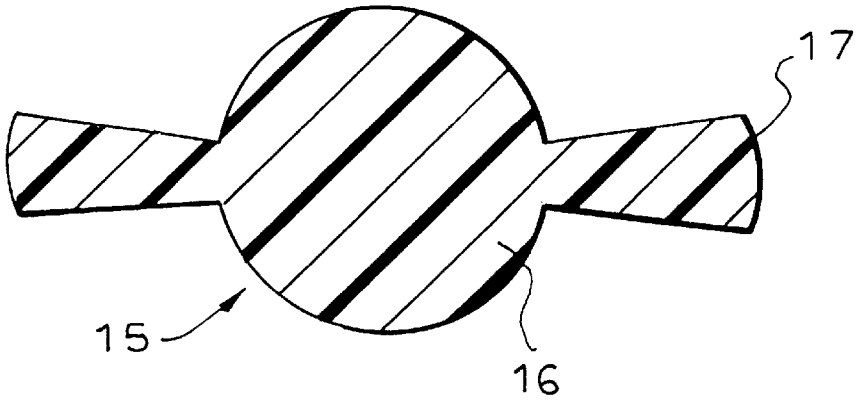
FIG. 2 is a cross sectional view of a game projectile according to the invention; and, FIG. 3 is a plan view of the game projectile of FIG. 2.
Figure 3:
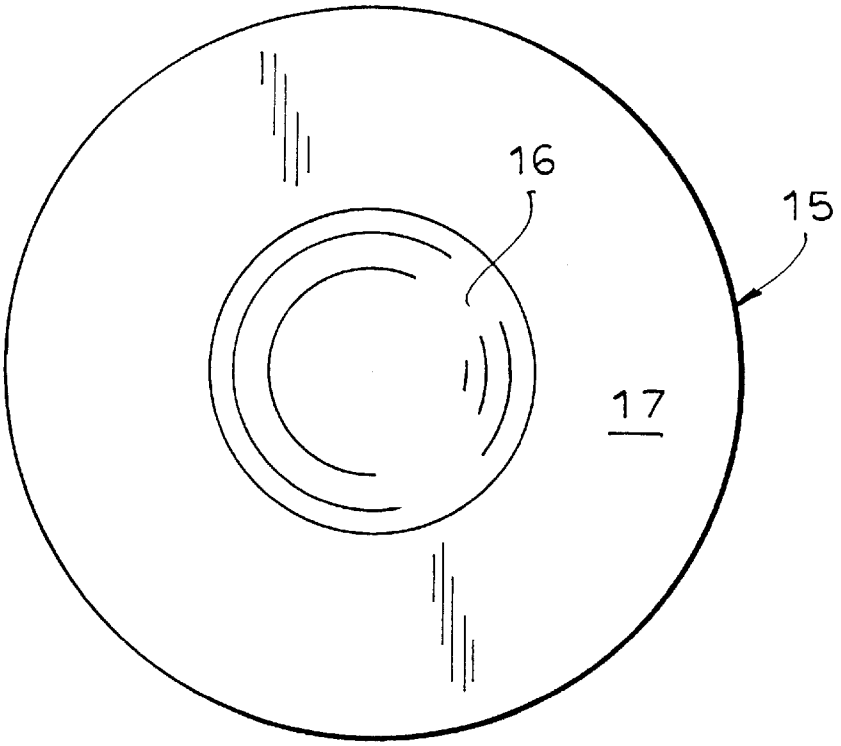

As shown in FIGS. 2 and 3, a game projectile 15 is molded in one piece from an elastomer and comprises a spherical portion 16 centrally mounted in an inwardly tapering, annular vane or wing 17 which provides the projectile with variable flight characteristics, somewhat analogous to a Frisbee, enabling it to soar in the updraft when the vane is horizontal.

In an alternative embodiment, the first and second goals and the projectile are magnetic so that the projectile adheres to a goal by magnetic attraction. The projectile may have strips of magnetic material attached to a surface thereof or otherwise be loaded with magnetic material.

The game comprises five players or flyers on each side. The duration of playing time is eighty minutes divided into four equal quarters of twenty minutes each with a thirty minute half time break. Overtime, in the event of equal or no score, is five minutes with a second overtime being sudden death.

The flyers enter the court through a door 18 in a major wall and the fans are turned on. At the commencement of the game, the projectile (SKYBALL) is ejected upward by the ejection means between opposing players in a "jump ball" for possession. Only a ball carrier can be tackled and when the tackled player's knees hit the floor, the player must release the projectile (similar to rugby union) which the tackler can pick up and continue. The tackler must pass the projectile or shoot from the position of ball spotting. Projectile stripping and pushing are allowed. The projectile may be passed in any direction. Ricochets off the walls into the goal score only one point, direct shots score two points. Ball possession passes to the team against which a goal is scored who must check it in the back of the court when the referee allows? Kicking and holding afford two penalty shots taken from mid court ? Players are permitted to hang from the ceiling net but can only drop on a ball carrier. Players may either fly or, (where possible), run across the court during play. A player reaching four penalties is removed from the game without substitution.

Constructional details and modifications to improve efficiency of operation may be incorporated from the teachings of the references identified above.

Other uses of the court (SKYCOURT) are sky surf Frisbee throwing, a non contact sport otherwise similar to SKYBALL; sky wrestling; SKYCOURT lap races, sky gymnastics (aerial competitions), and SKYSHOW in which performers carry glowing objects in a dark court with a musical accompaniment.

I claim:

1. Apparatus for an airborne team game comprising:

means for providing a chamber-form playing court having a perforate floor, a peripheral wall upstanding therefrom and first and second opposite ends with first and second goals, respectively;

a series of fans having outlets to the floor to provide an updraft throughout substantially the entire court, sufficient to support players bodies airborne, above the floor, so that individual players can traverse the court airborne between the goals during play while varying their elevations by varying the dispositions of their respective bodies in the updraft thereby to pass each other between the goals at different elevations;

and a game projectile which can be thrown by a player across the court into a selected goal to score.

2. Apparatus according to claim 1 wherein at least a portion of the peripheral wall extending between the goals is transparent to enable spectators outside the court to view a game.

3. Apparatus according to claim 1 wherein the court is rectangular in plan and has opposite major wall portions which are transparent.

4. Apparatus according to claim 1 wherein the floor comprises a player supporting elastomeric mesh.

5. Apparatus according to claim 2 wherein the floor comprises an elastomeric mesh extending over the fans.

6. Apparatus according to claim 1 wherein the court is enclosed at a top by a player restraining mesh.

7. Apparatus according to claim 4 wherein the court is enclosed at a top by a player restraining mesh.

8. Apparatus according to claim 4 including a game projectile ejection means comprising a bellows form, projectile delivering conduit communicating with an elastomeric mouth located at a central location of the court, with the mouth flush with the floor for yielding movement therewith.

9. Apparatus according to claim 1 wherein the first and second goals and the projectile are magnetic whereby the projectile is maintained in a goal by magnetic attraction.

10. Apparatus according to claim 1 wherein the first and second goals are formed by pockets in opposite end walls.

11. Apparatus according to claim 1 wherein player supporting perches are mounted on portions of the peripheral wall spaced above the floor.

12. Apparatus according to claim 11 wherein the perches are mounted for pivotal movement by a player between a collapsed position, lying against a sidewall and a horizontally extending player supporting position.

13. Apparatus according to claim 1 wherein the fans are mounted directly below the floor.

14. Apparatus according to claim 1 wherein the game projectile comprises a spherical portion centrally mounted in an annular vane.

15. A game projectile comprising a spherical portion centrally mounted in an inwardly tapering, annular vane or wing.

16. A game projectile according to claim 15 which is molded in one piece from elastomeric material.

17. A method of playing a competitive team game including the steps of providing first and second, spaced apart goals, a projectile that can be thrown by a player into a goal to score and an updraft between the goals sufficiently strong to maintain a player, suitably positioned in the updraft, airborne; providing two teams of players, individual players traversing the court airborne between the goals while varying their elevations by varying the positions of their respective bodies in the updraft thereby passing other players between the goals at different elevations, and attempting to score by throwing the projectile into a goal.

18. Apparatus for an airborne team game comprising:

means providing a playing court having a perforate floor and first and second opposite ends with first and second goals, respectively;

a series of fans having outlets to the floor to provide an updraft throughout substantially the entire court, sufficient to support players bodies airborne, above the floor, so that individual players can traverse the court airborne between the goals during play while varying their elevations by varying the dispositions of their respective bodies in the updraft thereby to pass each other between the goals at different elevations;

and a game projectile which can be thrown by a player across the court into a selected goal to score.

19. Apparatus according to claim 18 wherein the floor comprising an elastomeric mesh extending over the fans.

20. Apparatus according to claim 18 wherein the court is enclosed at a top by a player restraining mesh.

* * * * *